US012031539B2

(12) United States Patent
Akimoto et al.

(10) Patent No.: US 12,031,539 B2
(45) Date of Patent: Jul. 9, 2024

(54) ROTARY COMPRESSOR

(71) Applicant: FUJITSU GENERAL LIMITED, Kanagawa (JP)

(72) Inventors: Ryo Akimoto, Kanagawa (JP); Junya Tanaka, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 0 days.

(21) Appl. No.: 17/792,899

(22) PCT Filed: Sep. 30, 2020

(86) PCT No.: PCT/JP2020/037135
§ 371 (c)(1),
(2) Date: Jul. 14, 2022

(87) PCT Pub. No.: WO2021/152913
PCT Pub. Date: Aug. 5, 2021

(65) Prior Publication Data

US 2023/0067061 A1 Mar. 2, 2023

(30) Foreign Application Priority Data

Jan. 30, 2020 (JP) ..... 2020-014043

(51) Int. Cl.
*F04C 18/356* (2006.01)
*F04C 23/00* (2006.01)
(Continued)

(52) U.S. Cl.
CPC ..... *F04C 29/026* (2013.01); *F04C 18/3564* (2013.01); *F04C 29/12* (2013.01); *F04C 23/001* (2013.01); *F04C 2240/804* (2013.01)

(58) Field of Classification Search
CPC .... F04C 18/3564; F04C 29/026; F04C 29/06; F04C 29/12; F04C 23/001; F04C 23/008;
(Continued)

(56) References Cited

U.S. PATENT DOCUMENTS

2012/0171066 A1 7/2012 Shin et al.
2017/0130721 A1 5/2017 Morozumi
2017/0292520 A1 10/2017 Ueda et al.

FOREIGN PATENT DOCUMENTS

CN 2821232 Y 9/2006
CN 102562598 A 7/2012
(Continued)

OTHER PUBLICATIONS

JP2004360475A—Hayakawa et al.—Piping Connection Structure of Compressor—Dec. 12, 2004—English Machine Translation. (Year: 2004).*

(Continued)

*Primary Examiner* — Theresa Trieu
(74) *Attorney, Agent, or Firm* — Paratus Law Group, PLLC

(57) ABSTRACT

A rotary compressor includes a compressor housing that is provided with a refrigerant discharge portion and a refrigerant suction portion, and an accumulator that is fixed to the outer peripheral surface of the compressor housing and connected to the suction portion. The accumulator has a cylindrical body portion, which is formed of a resin material, an upper portion, which is formed of a metal material and closes an upper end of the body portion, and a lower portion, which is formed of a metal material and closes a lower end of the body portion, the upper portion is joined to the upper end of the body portion, and the lower portion is joined to the lower end of the body portion.

8 Claims, 7 Drawing Sheets

(51) Int. Cl.
*F04C 29/02* (2006.01)
*F04C 29/12* (2006.01)

(58) Field of Classification Search
CPC ..... F04C 2240/804; F05C 2201/00; F05C 2251/02; F05C 2253/20
See application file for complete search history.

(56) References Cited

FOREIGN PATENT DOCUMENTS

| | | | | | |
|---|---|---|---|---|---|
| CN | 107476973 | A | | 12/2017 | |
| CN | 107956694 | A | | 4/2018 | |
| JP | S62-223488 | A | | 10/1987 | |
| JP | H01-227885 | A | | 9/1989 | |
| JP | H11-132173 | A | | 5/1999 | |
| JP | 2004-218559 | A | | 8/2004 | |
| JP | 2004360476 | A | * | 12/2004 | ..... F04C 29/00 |
| JP | 2007021857 | A | * | 2/2007 | ..... B29C 45/14311 |
| JP | 2016-113943 | A | | 6/2016 | |
| JP | 2017-089521 | A | | 5/2017 | |
| JP | 2019-199997 | A | | 11/2019 | |
| KR | 20050062995 | A | * | 6/2005 | ..... F04C 18/356 |

OTHER PUBLICATIONS

KR20050062995A—Seo et al.—Discharge Apparatus for Rotary Systems Twin Compressor—Jun. 28, 2005—English Machine Translation. (Year: 2005).*

JP-2007021857-A Komoto et al.—Method for Coating Metal Rotor of Fluid Machine with Resin and Resin-coated Metal Rotor—Feb. 1, 2007—English Machine Translation. (Year: 2007).*

JP2019-199997A—Chinen—Compressor and refrigeration cycle equipment—Nov. 21, 2019—English Machine Translation. (Year: 2019).*

Jan. 30, 2024, Chinese Office Action issued for related CN Application No. 202080094215.8.

* cited by examiner

ROTARY COMPRESSOR

CROSS REFERENCE TO PRIOR APPLICATION

This application is a National Stage Patent Application of PCT International Patent Application No. PCT/JP2020/037135 (filed on Sep. 30, 2020) under 35 U.S.C. § 371, which claims priority to Japanese Patent Application No. 2020-014043 (filed on Jan. 30, 2020), which are all hereby incorporated by reference in their entirety.

FIELD

The present invention relates to a rotary compressor.

BACKGROUND

As compressors for air conditioners and refrigerators, a rotary compressor has been known that includes a compressor housing that is provided with a refrigerant discharge portion and a refrigerant suction portion, a compression unit that compresses the refrigerant, which is sucked from the suction portion, and discharges it from the discharge portion, a motor that drives the compression unit, and an accumulator that is fixed outside the compressor housing and connected to the suction portion.

In this type of rotary compressor, the accumulator has a metal-made accumulator container that includes a structure, which is supported by a mounting bracket, welded to the outer peripheral surface of the metal-made compressor housing.

CITATION LIST

Patent Literature

Patent Literature 1: Japanese Patent Application Laid-open No. 2017-89521

SUMMARY

Technical Problem

During the operation of the above-described rotary compressor, vibrations, which is generated in the metal compressor housing, are transmitted to the metal accumulator container via the mounting bracket, and cause a problem of increased noise as the accumulator container resonates, for example.

The disclosed technology has been made in view of the foregoing, and an object thereof is to provide a rotary compressor capable of suppressing the generation of vibration and reducing noise.

Solution to Problem

According to an aspect of an embodiments in the present application, a rotary compressor includes: a compressor housing that is provided with a refrigerant discharge portion and a refrigerant suction portion; a compression unit that is arranged inside the compressor housing and configured to compress a refrigerant, which is sucked from the suction portion, and discharge the refrigerant from the discharge portion; a motor that is arranged inside the compressor housing and configured to drive the compression unit; and an accumulator that is fixed to an outer peripheral surface of the compressor housing and connected to the suction portion, wherein an accumulator container of the accumulator has a cylindrical body portion, which is formed of a resin material, an upper portion, which is formed of a metal material and closes an upper end of the body portion, and a lower portion, which is formed of a metal material and closes a lower end of the body portion, the upper portion is joined to the upper end of the body portion, and the lower portion is joined to the lower end of the body portion.

Advantageous Effects of Invention

According to one aspect of the rotary compressor disclosed in the present application, the generation of vibration can be suppressed and noise can be reduced.

DESCRIPTION OF EMBODIMENTS

The following describes in detail an exemplary embodiment of a rotary compressor disclosed in the present application with reference to the accompanying drawings. The rotary compressor disclosed in the present application, is not limited by the following exemplary embodiments.

First Embodiment

Configuration of Rotary Compressor

Figure 1:
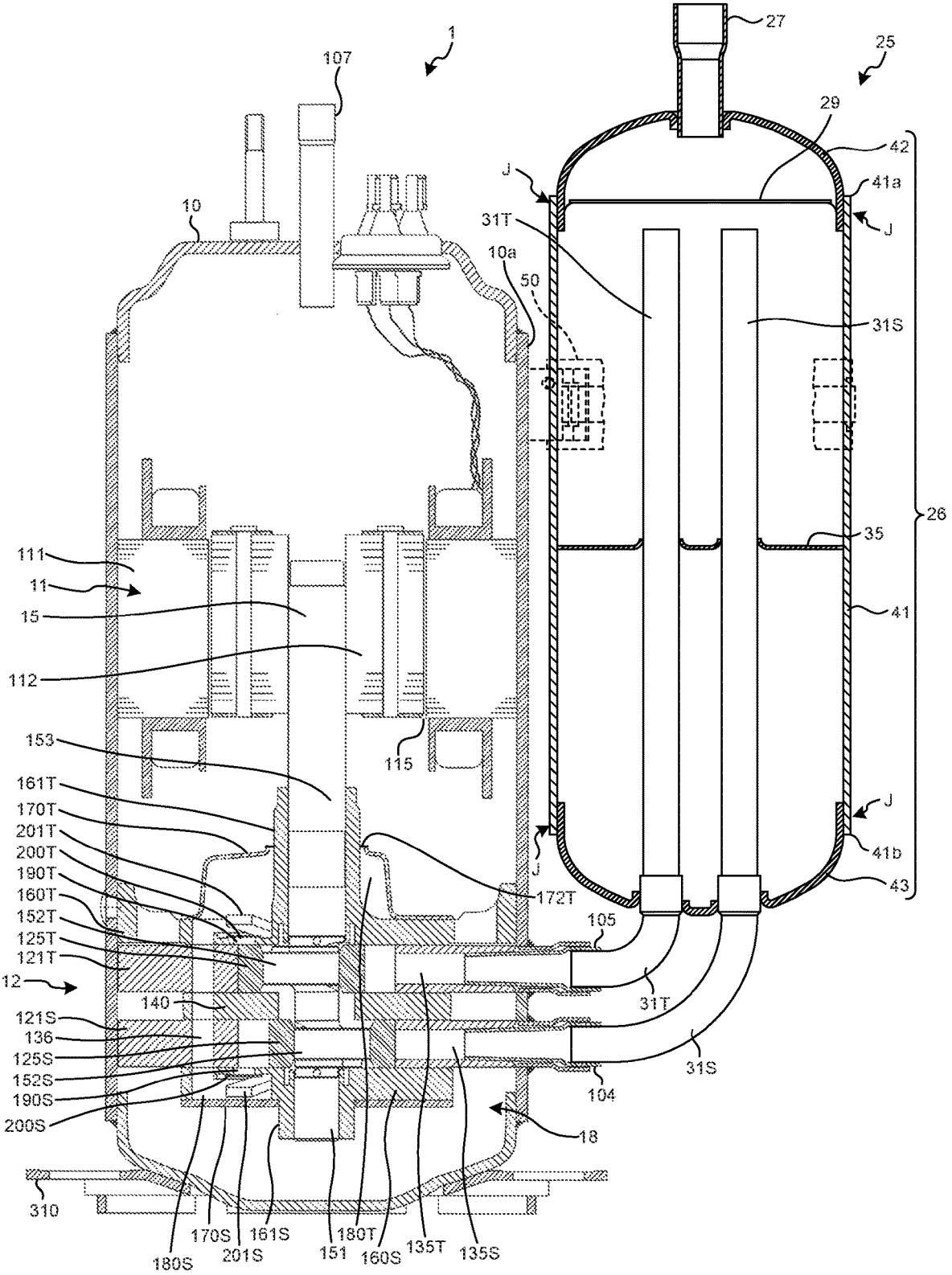
FIG. 1 is a longitudinal sectional view illustrating a rotary compressor of a first embodiment.
Figure 2:
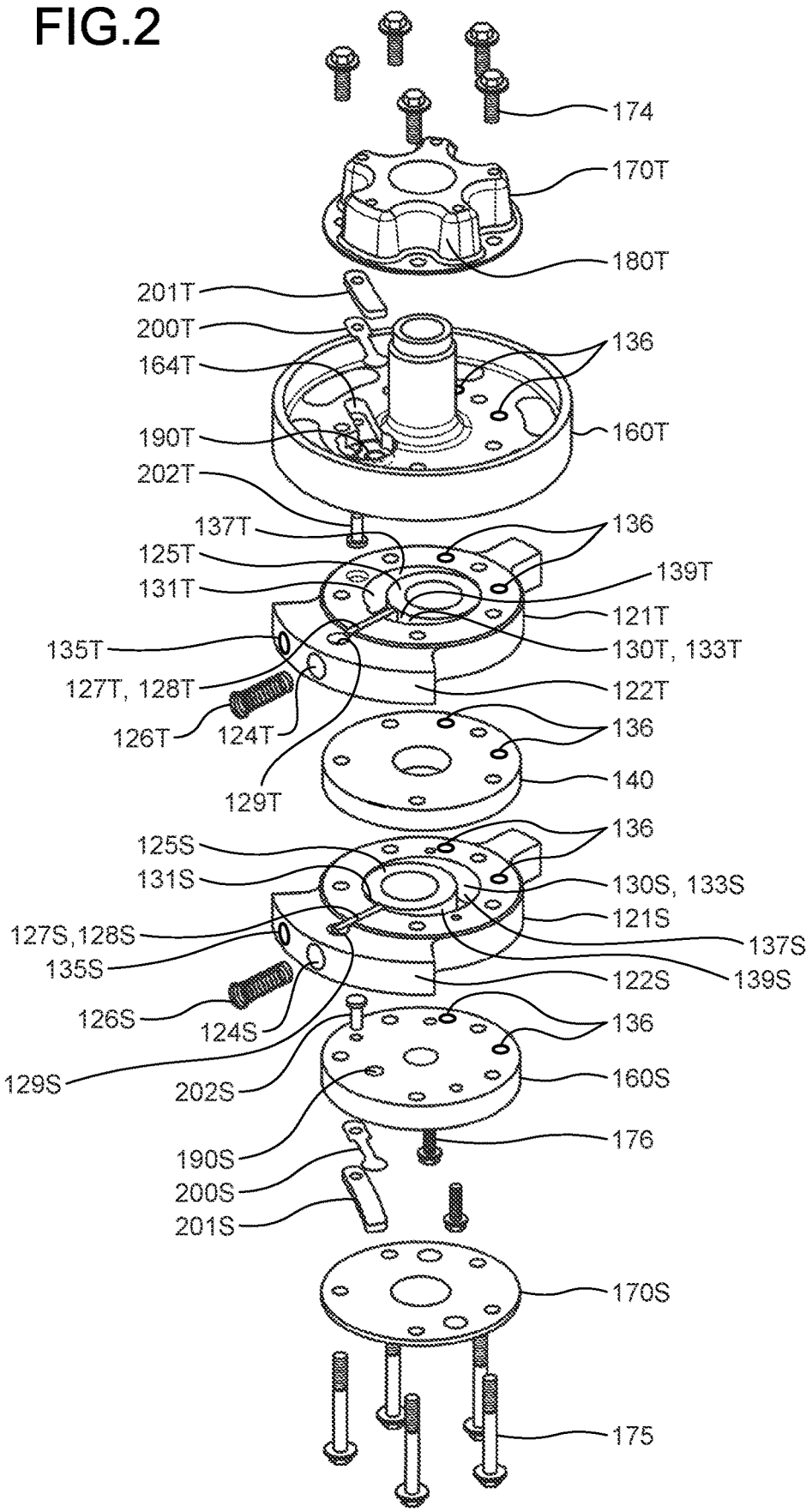
FIG. 2 is an exploded perspective view illustrating a compression unit of the rotary compressor of the first embodiment.

FIG. 1 is a longitudinal sectional view illustrating a rotary compressor of a first embodiment. FIG. 2 is an exploded perspective view illustrating a compression unit of the rotary compressor of the first embodiment.

As illustrated in FIG. 1, a rotary compressor 1 includes a compression unit 12 that is arranged at a lower portion in a sealed and vertical cylindrical compressor housing 10, a motor 11 that is arranged at an upper portion in the compressor housing 10 and configured to drive the compression unit 12 via a rotating shaft 15, and a vertical cylindrical accumulator 25 that is fixed to an outer peripheral surface of the compressor housing 10.

The accumulator 25 includes a vertically placed cylindrical accumulator container 26, and a low-pressure introduction pipe 27 that is connected to the upper portion of the accumulator container 26. The accumulator container 26 is connected to an upper cylinder chamber 130T (see FIG. 2) of an upper cylinder 121T via an upper suction pipe 105 and an L-shaped low-pressure connecting pipe 31T, and is connected to a lower cylinder chamber 130S (see FIG. 2) of a lower cylinder 121S via a lower suction pipe 104 and an L-shaped low-pressure connecting pipe 31S. The two low-pressure connecting pipes 31T and 31S extend from the lower portion to the upper portion inside the accumulator container 26, and are pipes, which is arranged inside the accumulator container 26. The low-pressure introduction pipe 27 is provided through the upper portion of the accumulator container 26, and is connected to the low-pressure side of a refrigerant pipe in the refrigeration cycle. In the accumulator container 26, between the low-pressure introduction pipe 27 and the low-pressure connecting pipes 31T and 31S, a filter 29 that captures foreign matter from the refrigerant, which is supplied from the low-pressure introduction pipe 27, is provided. The accumulator 25 sends the separated gas refrigerant from the accumulator container 26 to the compressor housing 10 through the two low-pressure connecting pipes 31T and 31S. The accumulator container 26 is fixed to an outer peripheral surface 10*a* of the compressor housing 10 by an accumulator holder 50.

The motor 11 includes a stator 111, which is arranged on the outside, and a rotor 112, which is arranged on the inside. The stator 111 is fixed to the inner peripheral surface of the compressor housing 10 in a shrink fitted state, and the rotor 112 is fixed to the rotating shaft 15 in a shrink fitted state.

A sub shaft portion 151 below a lower eccentric portion 152S is rotatably supported by a sub bearing portion 161S, which is provided on a lower end plate 160S, a main shaft portion 153 above an upper eccentric portion 152T is rotatably supported by a main bearing portion 161T, which is provided on an upper end plate 160T, and an upper piston 125T and a lower piston 125S are supported by the upper eccentric portion 152T and the lower eccentric portion 152S respectively that are provided with a phase difference of 180 degrees to each other, whereby the rotating shaft 15 is rotatably supported with respect to the compression unit 12, and causes the upper piston 125T and the lower piston 125S to revolve along an inner peripheral surface 137T of the upper cylinder 121T and an inner peripheral surface 137S of the lower cylinder 121S respectively by the rotation.

In the inside of the compressor housing 10, lubricating oil 18 is sealed by an amount that substantially immerses the compression unit 12, in order to ensure lubricity of sliding portions such as the upper piston 125T and the lower piston 125S, and the like sliding in the compression unit 12 and to seal an upper compression chamber 133T (see FIG. 2) and a lower compression chamber 133S (see FIG. 2). On the lower side of the compressor housing 10, fixed is a mounting leg 310 (see FIG. 1) that latches to a plurality of elastic supporting members (not depicted), which support the entire rotary compressor 1.

As illustrated in FIG. 1, the compressor housing 10 is provided with a discharge pipe 107 at the upper portion as a discharge portion for discharging a refrigerant, and an upper suction pipe 105 and a lower suction pipe 104 on the side portion as suction portions for sucking the refrigerant. The compression unit 12 compresses the refrigerant, which is sucked in from the upper suction pipe 105, and the lower suction pipe 104 and discharges it from the discharge pipe 107. As illustrated in FIG. 2, the compression unit 12 is made up of, from above, stacking an upper end plate cover 170T that has a bulging portion in which a hollow space is formed inside, the upper end plate 160T, the annular upper cylinder 121T, an intermediate partition plate 140, the annular lower cylinder 121S, the lower end plate 160S, and a flat plate-shaped lower end plate cover 170S. The entire compression unit 12 is fixed from above and below by a plurality of through bolts 174 and 175 and auxiliary bolts 176 arranged substantially concentrically.

As illustrated in FIG. 2, on the upper cylinder 121T, a cylindrical inner peripheral surface 137T is formed. On the inside of the inner peripheral surface 137T of the upper cylinder 121T, the upper piston 125T, which has an outer diameter smaller than the inner diameter of an inner peripheral surface 137T of the upper cylinder 121T, is arranged, and between the inner peripheral surface 137T and an outer peripheral surface 139T of the upper piston 125T, the upper compression chamber 133T, which sucks, compresses, and discharges the refrigerant, is formed. On the lower cylinder 121S, a cylindrical inner peripheral surface 137S is formed. On the inside of the inner peripheral surface 137S of the lower cylinder 121S, the lower piston 125S, which has an outer diameter smaller than the inner diameter of the inner peripheral surface 137S of the lower cylinder 121S, is arranged, and between the inner peripheral surface 137S and an outer peripheral surface 139S of the lower piston 125S, the lower compression chamber 133S, which sucks, compresses, and discharges the refrigerant, is formed.

The upper cylinder 121T includes an upper lateral projecting portion 122T, which projects in the radial direction of the cylindrical inner peripheral surface 137T from a circular outer peripheral portion. On the upper lateral projecting portion 122T, an upper vane groove 128T, which extends radially outward from the upper cylinder chamber 130T, is provided. In the upper vane groove 128T, an upper vane 127T is arranged to be slidable. The lower cylinder 121S includes a lower lateral projecting portion 122S, which projects in the radial direction of the cylindrical inner peripheral surface 137S from the circular outer peripheral portion. On the lower lateral projecting portion 122S, a lower vane groove 128S, which extends radially outward from the lower cylinder chamber 130S, is provided. In the lower vane groove 128S, a lower vane 127S is arranged to be slidable.

On the upper cylinder 121T, from the outer lateral surface at the position overlapping the upper vane groove 128T, an upper spring hole 124T is provided at a depth not running through the upper cylinder chamber 130T. At the upper spring hole 124T, an upper spring 126T is arranged. On the lower cylinder 121S, from the outer lateral surface at the position overlapping the lower vane groove 128S, a lower spring hole 124S is provided at a depth not running through the lower cylinder chamber 130S. At the lower spring hole 124S, a lower spring 126S is arranged.

On the lower cylinder 121S, formed is a lower pressure guiding path 129S that guides the compressed refrigerant in the compressor housing 10 by making the outside in the radial direction of the lower vane groove 128S communicate with the inside of the compressor housing 10 via an opening, and that applies a back pressure to the lower vane 127S by the pressure of the refrigerant. The compressed refrigerant in the compressor housing 10 is also introduced from the lower spring hole 124S. On the upper cylinder 121T, formed is an upper pressure guiding path 129T that guides the compressed refrigerant in the compressor housing 10 by making the outside in the radial direction of the upper vane groove 128T communicate with the inside of the compressor housing 10 via an opening, and that applies a back pressure to the upper vane 127T by the pressure of the refrigerant. The compressed refrigerant in the compressor housing 10 is also introduced from the upper spring hole 124T.

On the upper lateral projecting portion 122T of the upper cylinder 121T, an upper suction hole 135T as a through-hole to which the upper suction pipe 105 is fitted is provided. On the lower lateral projecting portion 122S of the lower cylinder 121S, a lower suction hole 135S, as a through-hole to which the lower suction pipe 104, is fitted is provided.

The upper cylinder chamber 130T is closed at the upper and lower sides by the upper end plate 160T and the intermediate partition plate 140, respectively. The lower cylinder chamber 130S is closed at the upper and lower sides by the intermediate partition plate 140 and the lower end plate 160S, respectively.

Figure 3:
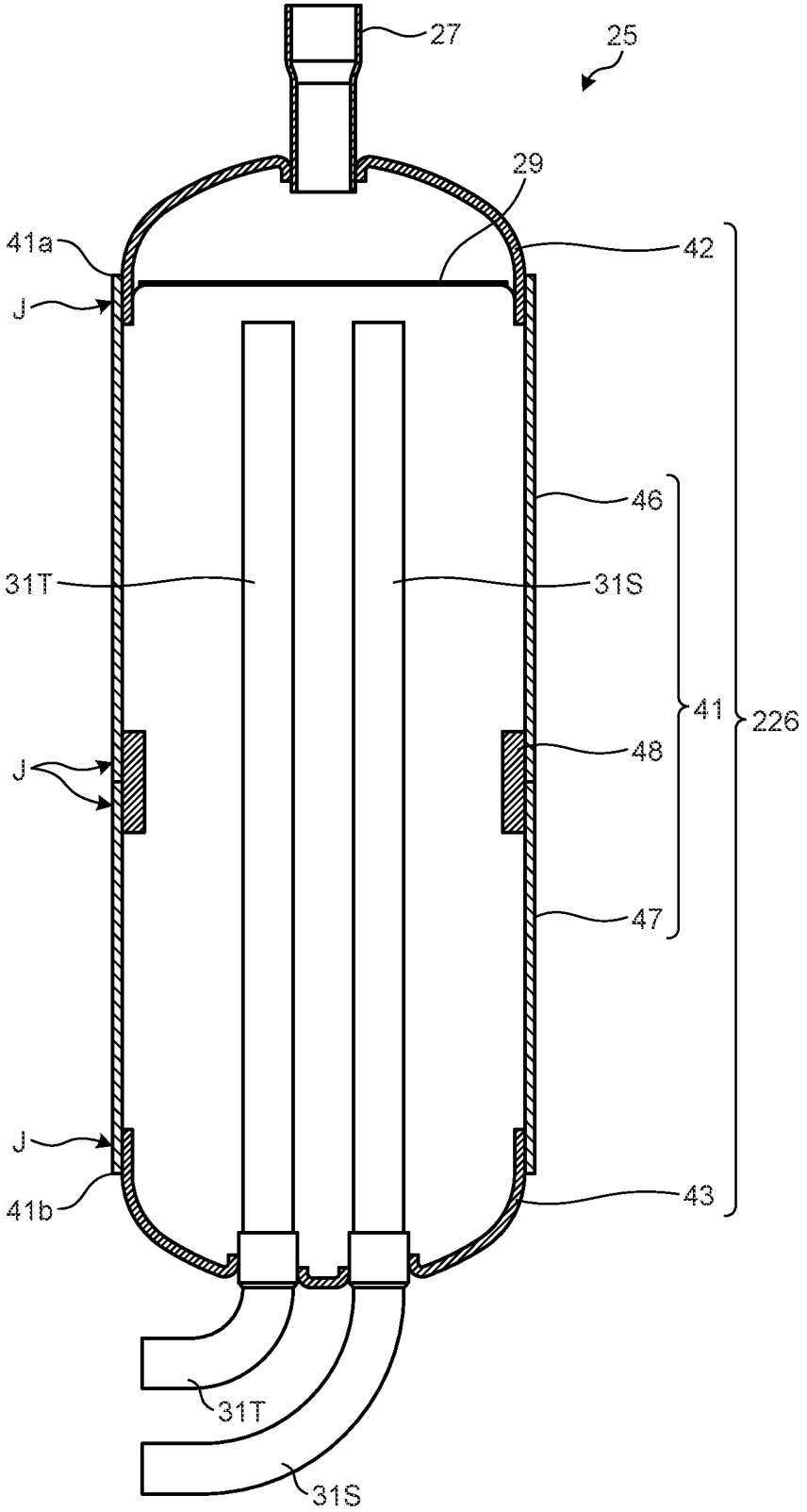
FIG. 3 is a longitudinal sectional view illustrating an accumulator container in a second embodiment.

The upper cylinder chamber 130T is sectioned, as the upper vane 127T is pressed by the upper spring 126T and is brought into contact with the outer peripheral surface 139T of the upper piston 125T, into an upper suction chamber 131T that communicates with the upper suction hole 135T, and into the upper compression chamber 133T that communicates with an upper discharge hole 190T, which is provided on the upper end plate 160T (see FIG. 3). The lower cylinder chamber 130S is sectioned, as the lower vane 127S is pressed by the lower spring 126S and is brought into contact with the outer peripheral surface 139S of the lower piston 125S, into a lower suction chamber 131S that communicates with the lower suction hole 135S, and into the lower compression chamber 133S that communicates with a lower discharge hole 190S, which is provided on the lower end plate 160S (see FIG. 3).

As illustrated in FIG. 2, on the upper end plate 160T, the upper discharge hole 190T, which passes through the upper end plate 160T and communicates with the upper compression chamber 133T of the upper cylinder 121T, is provided, and on the outlet side of the upper discharge hole 190T, an upper valve seat (not depicted) is formed around the upper discharge hole 190T. On the upper end plate 160T, an upper discharge-valve accommodating recessed portion 164T, which extends in a groove shape in the circumferential direction of the upper end plate 160T from the position of the upper discharge hole 190T, is formed.

In the upper discharge-valve accommodating recessed portion 164T, accommodated are a reed-valve type upper discharge valve 200T for which the rear end portion is fixed in the upper discharge-valve accommodating recessed portion 164T by an upper rivet 202T, and the front portion opens and closes the upper discharge hole 190T, and an entire upper discharge valve retainer 201T for which the rear end portion is overlapped with the upper discharge valve 200T and fixed in the upper discharge-valve accommodating recessed portion 164T by the upper rivet 202T, and the front portion is curved (warped) and regulates the opening degree of the upper discharge valve 200T.

On the lower end plate 160S, the lower discharge hole 190S, which passes through the lower end plate 160S and communicates with the lower compression chamber 133S of the lower cylinder 121S, is provided. On the lower end plate 160S, a lower discharge-valve accommodating recessed portion (not depicted), which extends in a groove shape in the circumferential direction of the lower end plate 160S from the position of the lower discharge hole 190S, is formed.

In the lower discharge-valve accommodating recessed portion, accommodated are a reed-valve type lower discharge valve 200S for which the rear end portion is fixed in the lower discharge-valve accommodating recessed portion by a lower rivet 202S, and the front portion opens and closes the lower discharge hole 190S, and an entire lower discharge valve retainer 201S for which the rear end portion is overlapped with the lower discharge valve 200S and fixed in the lower discharge-valve accommodating recessed portion by the lower rivet 202S, and the front portion is curved (warped) and regulates the opening degree of the lower discharge valve 200S.

In addition, between the upper end plate 160T and the upper end plate cover 170T having the bulging portion that are closely fixed to each other, an upper end-plate cover chamber 180T is formed. Between the lower end plate 160S and the flat plate-shaped lower end plate cover 170S that are closely fixed to each other, a lower end-plate cover chamber 180S (see FIG. 1) is formed. A plurality of refrigerant passage holes 136, which run through the lower end plate 160S, the lower cylinder 1213, the intermediate partition plate 140, the upper end plate 160T, and the upper cylinder 121T and that communicates with the lower end-plate cover chamber 180S and the upper end-plate cover chamber 180T, is provided.

The following describes the flow of refrigerant by the rotation of the rotating shaft 15. In the upper cylinder chamber 130T, by the rotation of the rotating shaft 15, as the upper piston 125T fitted to the upper eccentric portion 152T of the rotating shaft 15 revolves along the inner peripheral surface 137T of the upper cylinder 121T (outer peripheral surface of the upper cylinder chamber 130T), the upper suction chamber 131T sucks the refrigerant from the upper suction pipe 105 while expanding the volume, the upper compression chamber 133T compresses the refrigerant while reducing the volume, and when the pressure of the compressed refrigerant becomes higher than the pressure of the upper end-plate cover chamber 180T outside of the upper discharge valve 200T, the upper discharge valve 200T is opened, and the refrigerant is discharged from the upper compression chamber 133T to the upper end-plate cover chamber 180T. The refrigerant, which is discharged to the upper end-plate cover chamber 180T, is discharged into the compressor housing 10 from an upper end-plate cover discharge hole 172T (see FIG. 1), which is provided on the upper end plate cover 170T.

Furthermore, in the lower cylinder chamber 130S, by the rotation of the rotating shaft 15, as the lower piston 125S, which is fitted to the lower eccentric portion 152S of the rotating shaft 15, revolves along the inner peripheral surface 137S of the lower cylinder 121S (outer peripheral surface of the lower cylinder chamber 130S), the lower suction chamber 131S sucks the refrigerant from the lower suction pipe 104 while expanding the volume, the lower compression chamber 133S compresses the refrigerant while reducing the volume, and when the pressure of the compressed refrigerant becomes higher than the pressure of the lower end-plate cover chamber 180S outside of the lower discharge valve 200S, the lower discharge valve 200S is opened, and the refrigerant is discharged from the lower compression chamber 133S to the lower end-plate cover chamber 180S. The refrigerant, which is discharged to the lower end-plate cover chamber 180S, passes through the refrigerant passage holes 136 and the upper end-plate cover chamber 180T, and is discharged into the compressor housing 10 from the upper end-plate cover discharge hole 172T, which is provided on the upper end plate cover 170T.

The refrigerant, which is discharged into the compressor housing 10, is guided to the upper side of the motor 11 through a cutout (not depicted), which is provided on the outer periphery of the stator 111 and communicating with the upper and lower portions, a gap (not depicted) in a winding portion of the stator 111, or a gap 115 (see FIG. 1) between the stator 111 and the rotor 112, and is discharged from the discharge pipe 107 as a discharge portion arranged on the upper portion of the compressor housing 10.

Characteristic Configuration of Rotary Compressor Next, a characteristic configuration of the rotary compressor 1 of the first embodiment will be described. Features of the first embodiment include the accumulator container 26 of the accumulator 25. In the first embodiment, the compressor housing 10 and the accumulator holder 50 are formed of a metal material such as a steel plate. As illustrated in FIG. 1, the accumulator container 26 has a cylindrical body portion 41, which is formed of a resin material, a cup-shaped upper portion 42, which is formed of a metal material and closes an upper end 41*a* of the body portion 41, and a cup-shaped lower portion 43, which is formed of a metal material and closes a lower end 41*b* of the body portion 41.

The accumulator container 26 is formed by combining the body portion 41, the upper portion 42, and the lower portion 43. The upper portion 42 is joined to the upper end 41*a* of the body portion 41. The lower portion 43 is joined to the lower end 41*b* of the body portion 41. The body portion 41 of the accumulator container 26 is fixed to the compressor housing 10 by the metal-made accumulator holder 50, which is welded to the outer peripheral surface 10*a* of the compressor housing 10. As in the foregoing, the accumulator container 26 has the resin-made body portion 41, so that vibrations, particularly in a low-frequency band, during the operation of the rotary compressor 1 are suppressed, and the noise of the rotary compressor 1 is suppressed.

The inner peripheral surface of the upper end 41*a* of the body portion 41 overlaps the outer peripheral surface of the upper portion 42, and is irradiated with a laser from the outside of the body portion 41 toward the upper portion 42 side, so that the resin body portion 41 and the metal upper portion 42 are joined. Similarly, the inner peripheral surface of the lower end 41*b* of the body portion 41 overlaps the outer peripheral surface of the lower portion 43, and is irradiated with a laser from the outside of the body portion 41 toward the lower portion 43 side, so that the resin body portion 41 and the metal lower portion 43 are joined. That is, each joint portion J is formed by being irradiated with the laser from the resin material side toward the metal material side. The joint portion J is formed in a line shape, which extends in the circumferential direction of the body portion 41.

By heating up to a temperature at which bubbles are produced in the resin material of the body portion 41 when the body portion 41 is irradiated with the laser, the mechanical strength of the joint portion J between the resin body portion 41 and the metal upper portion 42, and the joint portion J between the resin body portion 41 and the metal lower portion 43, is properly ensured. In this case, the tensile shear strength of the joint portion J can be ensured to 5 MPa or more, for example.

The upper portion 42 is provided with the low-pressure introduction pipe 27 that introduces refrigerant into the accumulator container 26, and the low-pressure introduction pipe 27 is connected to the refrigerant pipe that constitutes the refrigeration cycle, which is not depicted. The lower portion 43 is provided with the low-pressure connecting pipe 31T and the low-pressure connecting pipe 31S that extend to the inside of the body portion 41. The low-pressure connecting pipes 31T and 31S are supported by a metal-made supporting plate 35, which is attached inside the body portion 41.

In order to properly join the body portion 41 to the upper portion 42 and the body portion 41 to the lower portion 43, respectively, by laser bonding, it is preferable that, as the resin material for forming the body portion 41, a thermoplastic resin material be used and have functional groups that are reactive with the metal materials, which form the upper portion 42 and the lower portion 43. As such resin materials, for example, polyamide (PA) and polybutylene terephthalate (PBT) are used.

As the resin material for forming the body portion 41, it is preferable that, in order to properly ensure the mechanical strength and heat resistance of the portions other than each of the joint portions J with the upper portion 42 and the lower portion 43, a super engineering plastic such as polyether nitrile (PEN) be used, for example. Because a low-temperature and low-pressure refrigerant before being compressed in the compression unit 12 passes through the accumulator 25, a resin material, which has relatively low mechanical strength and relatively low heat resistance, can be used as long as it is within the tolerable range of withstanding the pressure and temperature of the refrigerant. As the metal material for forming the upper portion 42 and the lower portion 43, for example, iron, copper, aluminum, and the like are used.

As the resin material for forming the body portion 41, in order to enhance the vibration-damping properties by the body portion 41, a resin material containing a vibration-damping agent may be used. As such a vibration-damping agent, for example, N-dicyclohexylbenzothiazyl-2-sulfenamide (DCHBSA), 2-mercaptobenzothiazole (MBT), and the like are used.

At the time of installing the rotary compressor 1, the low-pressure introduction pipe 27 of the accumulator 25 and the refrigerant pipe (not depicted) are welded. Thus, as the upper portion 42 of the accumulator container 26 is formed of a metal material, it is possible to avoid the occurrence of damage such as deformation of the accumulator container 26 due to the transfer of the heat, which is generated at the time of welding between the low-pressure introduction pipe 27 and the refrigerant pipe, to the upper portion 42 of the accumulator container 26. In other words, as the upper portion 42 is formed of a metal material, the welding work between the low-pressure introduction pipe 27 of the accumulator 25 and the refrigerant pipe, can be easily performed when the rotary compressor 1 is installed.

The accumulator container 26 in the first embodiment has the joint portion J at which the body portion 41 and the upper portion 42 are laser bonded, and the joint portion J at which the body portion 41 and the lower portion 43 are laser bonded, but the body portion 41 may be integrally molded by insert molding with either the upper portion 42 or the lower portion 43, for example. In this case, in the accumulator container 26, for example, using a container component for which the body portion 41 and the lower portion 43 are integrally molded, the body portion 41 of this container component and the upper portion 42 are joined by laser bonding, thereby forming the joint portion J.

Effect of First Embodiment

In the rotary compressor 1 of the first embodiment, the accumulator container 26 of the accumulator 25, which is fixed to the outer peripheral surface 10*a* of the compressor housing 10, has the cylindrical body portion that is formed of a resin material, the upper portion 42 that is formed of a metal material and closes the upper end 41*a* of the body portion, and the lower portion 43 that is formed of a metal material and closes the lower end 41*b* of the body portion 41, and the upper portion 42 is joined to the upper end 41*a* of the body portion 41, and the lower portion 43 is joined to the lower end 41*b* of the body portion 41. In general, the modulus of longitudinal elasticity of a resin material is less than 1/100 of that of a metal material, making it hard to transmit vibration as compared with the metal material. Thus, according to the first embodiment, it is possible to use the accumulator container 26 that is formed of a resin material having higher vibration-damping properties relative to a metal material, and as compared with a structure that includes the accumulator container formed of a steel plate, the generation of vibration of the rotary compressor 1 can be suppressed, and the noise associated with the vibration can be reduced.

As the joint portion J between the resin body portion 41 and the metal upper portion 42, and the joint portion J between the resin body portion 41 and the metal lower portion 43, are laser bonded, for example, the bonding strength of the joint portions J is properly ensured, so that the mechanical strength of the accumulator container 26 can be ensured.

In addition, as the accumulator container 26 has the metal upper portion 42, the accumulator container 26 can be prevented from being damaged due to the heat generated at the time of welding between the low-pressure connecting pipes 31T and 31S of the accumulator 25 and the refrigerant pipes of the refrigeration cycle. Thus, when the rotary compressor 1 is installed, the welding work between the low-pressure connecting pipes 31T and 31S of the accumulator 25 and the refrigerant pipes, can be easily performed.

In the accumulator container 26 of the accumulator 25 in the first embodiment, the inner peripheral surface of the upper end 41*a* of the body portion 41 is joined to the outer peripheral surface of the upper portion 42, and the inner peripheral surface of the lower end 41*b* of the body portion 41 is joined to the outer peripheral surface of the lower portion 43. This makes it possible for the laser to irradiate from the outside of the accumulator container 26, from the resin material side toward the metal material side, so that the mechanical strength of the laser-bonded joint portion J can be properly ensured.

The following describes other embodiments with reference to the drawings. In a second embodiment and a third embodiment, the structure of the accumulator container is different from that of the accumulator container 26 in the first embodiment. Thus, in the second and the third embodiments, the constituent members identical to those of the first embodiment are denoted by the reference signs identical to those of the first embodiment and the description thereof will be omitted, and the accumulator container will be described.

Second Embodiment

Figure 4:
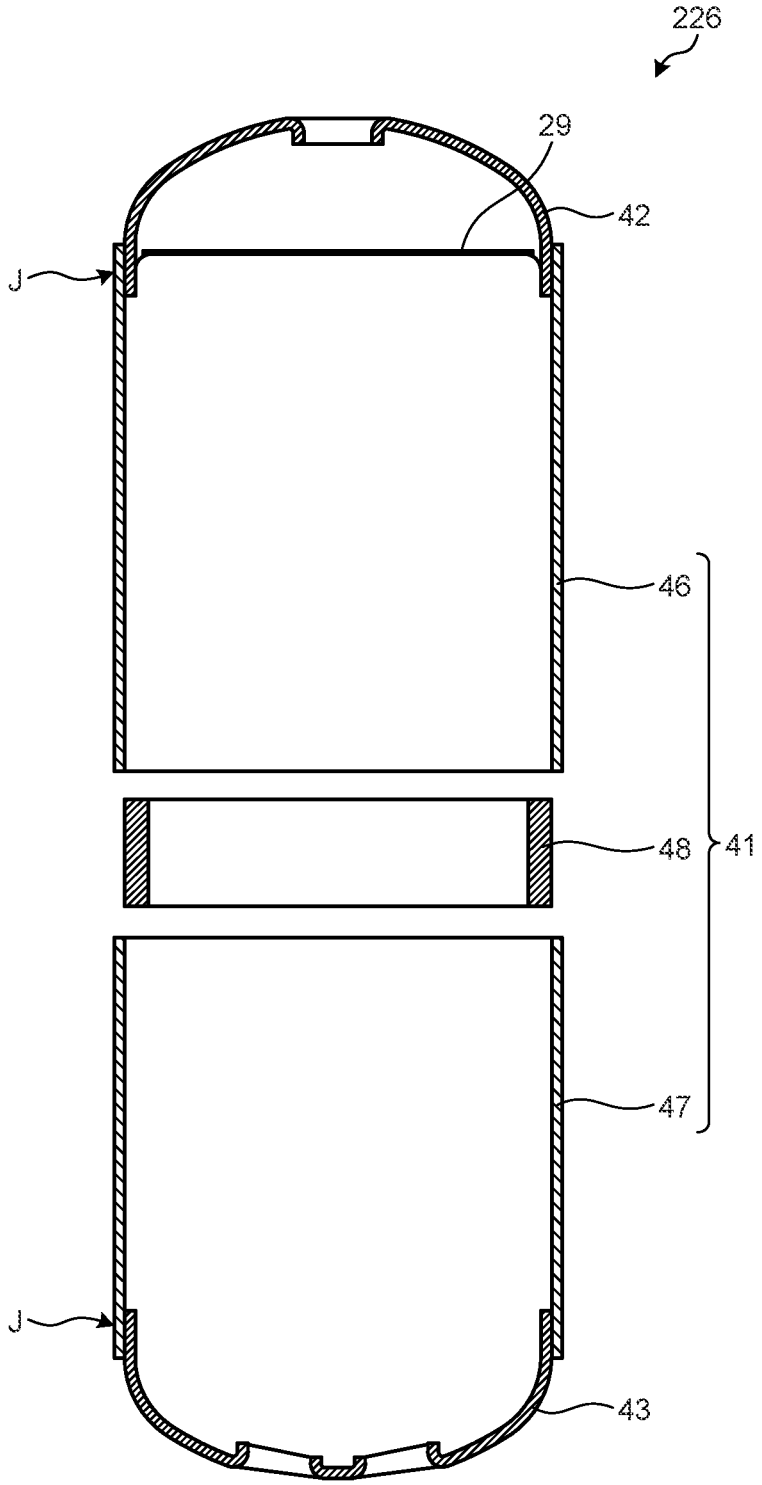
FIG. 4 is an exploded longitudinal sectional view illustrating the accumulator container in the second embodiment.
Figure 5:
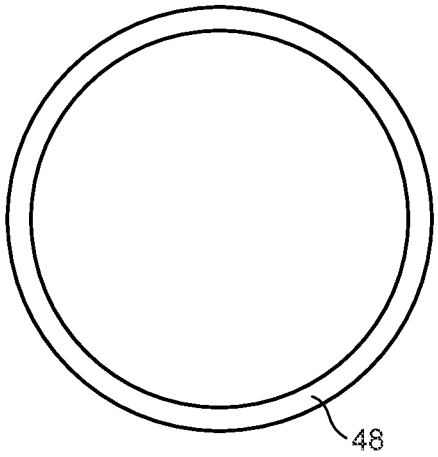
FIG. 5 is a plan view illustrating an intermediate portion of the accumulator container in the second embodiment.

FIG. 3 is a longitudinal sectional view illustrating an accumulator container in a second embodiment. FIG. 4 is an exploded longitudinal sectional view illustrating the accumulator container in the second embodiment. FIG. 5 is a plan view illustrating an intermediate portion of the accumulator container in the second embodiment. The second embodiment is different from the first embodiment in that it has a body portion 41 to which a plurality of components are joined.

As illustrated in FIG. 3 and FIG. 4, the accumulator 25 in the second embodiment has an accumulator container 226. As illustrated in FIG. 4 and FIG. 5, the body portion 41 of the accumulator container 226 has a cylindrical upper body portion 46, which is formed of a resin material to which the upper portion 42 is joined, a cylindrical lower body portion 47, which is formed of a resin material to which the lower portion 43 is joined, and a ring-shaped intermediate portion 48, which is formed of a metal material.

The inner peripheral surface of the upper end 41*a* of the upper body portion 46 is joined to the outer peripheral surface of the upper portion 42. The inner peripheral surface of the lower end 41*b* of the lower body portion 47 is joined to the outer peripheral surface of the lower portion 43. The upper body portion 46 and the upper portion 42, and the lower body portion 47 and the lower portion 43, have the laser-bonded joint portion J, as in the first embodiment. The upper body portion 46 and the upper portion 42, and the lower body portion 47 and the lower portion 43 may be joined by, instead of laser bonding, being integrally molded by insert molding, for example.

As the resin material for forming the upper body portion 46 and the lower body portion 47, it is preferable that a thermoplastic resin material be used and have functional groups, which are reactive with the metal materials that form the upper portion 42, the lower portion 43, and the intermediate portion 48. As the resin material for forming the upper body portion 46 and the lower body portion 47, in order to properly ensure the mechanical strength and heat resistance of the portions other than each of the joint portions J with the upper portion 42, the lower portion 43, and the intermediate portion 48, it is preferable that a super engineering plastic such as polyether nitrile (PEN) be used, for example.

The outer peripheral surface of the intermediate portion 48 is joined to the inner peripheral surface of the lower end of the upper body portion 46 and the inner peripheral surface of the upper end of the lower body portion 47. The inner peripheral surface of the lower end of the upper body portion 46 overlaps the outer peripheral surface of the intermediate portion 48, and is irradiated with a laser from the outside of the upper body portion 46 toward the intermediate portion 48 side, so that the resin upper body portion 46 and the metal intermediate portion 48 are joined. Similarly, the inner peripheral surface of the upper end of the lower body portion 47 overlaps the outer peripheral surface of the intermediate portion 48, and is irradiated with a laser from the outside of the lower body portion 47 toward the intermediate portion 48 side, so that the resin lower body portion 47 and the metal intermediate portion 48 are joined. That is, the joint portions J are formed by being irradiated with the laser from the resin material side toward the metal material side. As the metal material for forming the intermediate portion 48, for example, iron, copper, aluminum, and the like are used.

The accumulator 25 is formed by joining the upper portion 42 and the upper body portion 46 to attach the low-pressure introduction pipe 27 and the filter 29, and by joining the lower portion 43 and the lower body portion 47 to attach the low-pressure connecting pipes 31T and 31S, and then by laser bonding each of the upper body portion 46 and the lower body portion 47 to the intermediate portion 48.

Although not depicted, inside the accumulator container 226, the metal supporting plate 35 (see FIG. 1), which supports the low-pressure connecting pipes 31T and 31S, may be provided. The supporting plate 35 is attached to the inner peripheral surface of the upper body portion 46, for example. The supporting plate 35 may be attached to the inner peripheral surface of the intermediate portion 48.

In the body portion 41 in the second embodiment, the resin upper body portion 46 and the resin lower body portion 47 have been joined via the metal intermediate portion 48, but the embodiment is not limited to a structure having the intermediate portion 48. For example, in the body portion 41, the resin upper body portion 46 and the resin lower body portion 47 may be directly joined by welding. In this case also, the upper body portion 46 and the upper portion 42 may be integrally molded, or the lower body portion 47 and the lower portion 43 may be integrally molded. In the accumulator container 226, the intermediate portion 48 may be integrally molded with either the upper body portion 46 or the lower body portion 47.

Effect of Second Embodiment

According to the second embodiment, as with the first embodiment, it is possible to use the accumulator container 226 made of a resin material having high vibration-damping properties, so that the generation of vibration of the rotary compressor 1 can be suppressed, and the noise associated with the vibration can be reduced.

The accumulator container 226 in the second embodiment has the upper body portion 46, the lower body portion 47, and the intermediate portion 48, so that it is possible to integrally mold the upper body portion 46 and the upper portion 42, and integrally mold the lower body portion 47 and the lower portion 43. As in the foregoing, in the accumulator container 226, the upper portion 42 and the upper body portion 46 are integrally molded, and the lower portion 43 and the lower body portion 47 are integrally formed, so that the two laser joints of the joint portion J between the upper portion 42 and the body portion 41, and the joint portion J between the lower portion 43 and the body portion 41 in the first embodiment, can be performed collectively on the intermediate portion 48. This enhances the workability of the laser bonding process of the accumulator container 226.

According to the second embodiment, by adjusting the thickness of the intermediate portion 48 in the radial direction of the accumulator container 226, the mechanical strength of the joint portion J between an upper body portion 46 and the intermediate portion 48, and the joint portion J between the lower body portion 47 and the intermediate portion 48, can be easily ensured. For example, by increasing the thickness of the intermediate portion 48, the mechanical strength of the joint portion J can be increased.

THIRD EMBODIMENT

Figure 6:
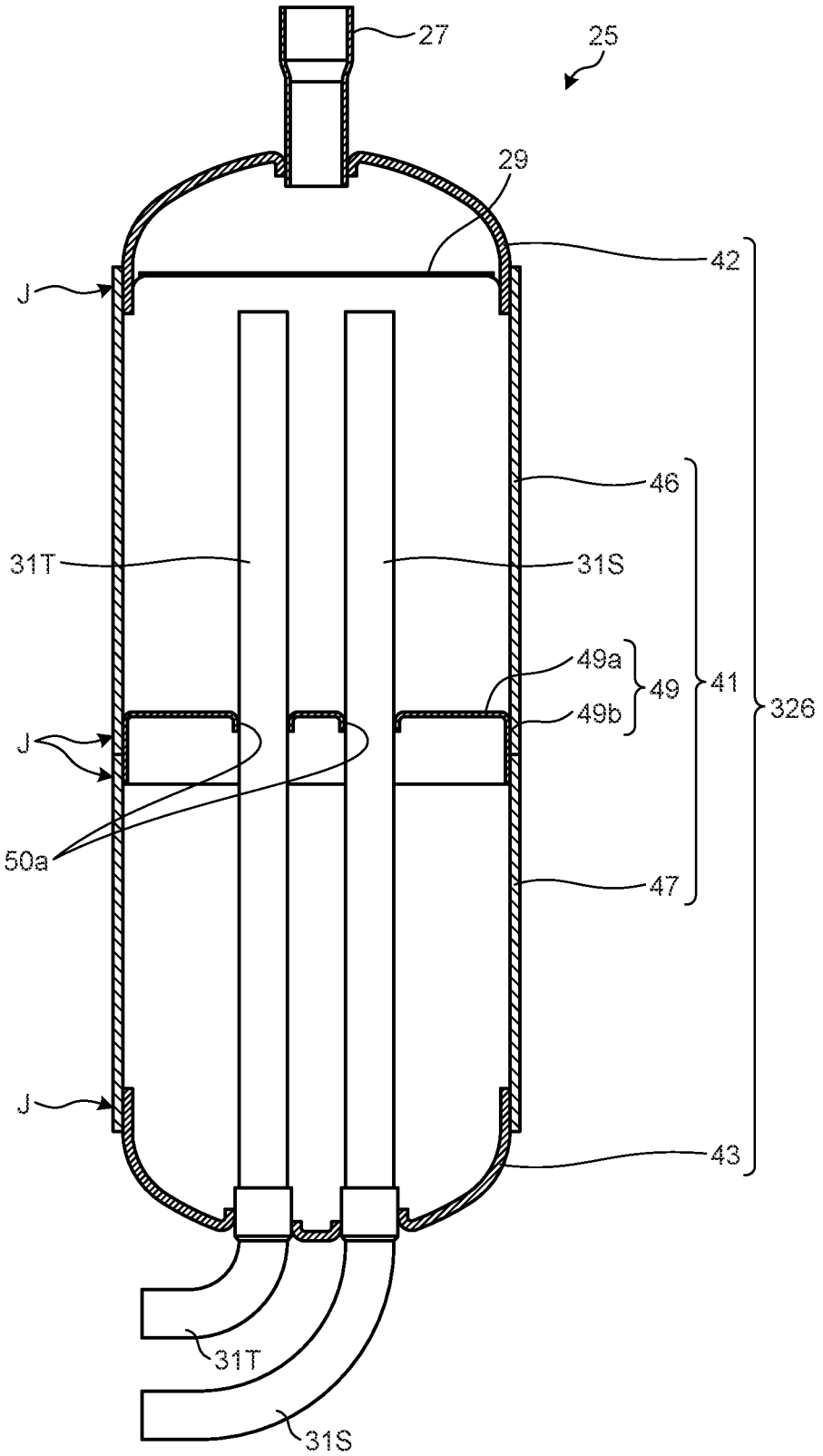
FIG. 6 is a longitudinal sectional view illustrating an accumulator container in a third embodiment.
Figure 7:
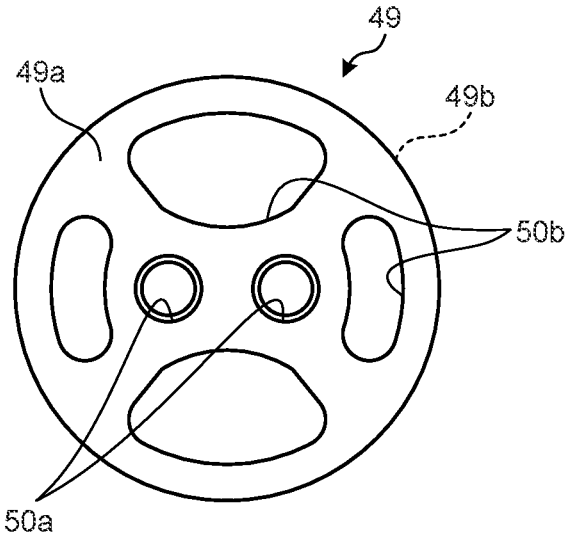
FIG. 7 is a plan view illustrating an intermediate portion of the accumulator container in the third embodiment.

FIG. 6 is a longitudinal sectional view illustrating an accumulator container in a third embodiment. FIG. 7 is a plan view illustrating an intermediate portion of the accumulator container in the third embodiment. The accumulator container in the third embodiment is different from the second embodiment in that an intermediate portion, which supports the low-pressure connecting pipes 31T and 31S, is provided.

As illustrated in FIG. 6, the accumulator 25 in the third embodiment has an accumulator container 326. As illustrated in FIG. 6 and FIG. 7, the body portion 41 of the accumulator container 326 has, as in the second embodiment, the resin upper body portion 46, the resin lower body portion 47, and a metal intermediate portion 49.

The intermediate portion 49 in the third embodiment also serves as the above-described supporting plate 35 and has a disc-shaped supporting portion 49*a*, which supports the low-pressure connecting pipes 31T and 31S as pipes, and a flange portion 49*b*, which is formed over the outer periphery of the supporting portion 49*a*. The outer peripheral surface of the flange portion 49*b* is, as with the intermediate portion 48 in the second embodiment, joined to the inner peripheral surface of the lower end of the upper body portion 46 and the inner peripheral surface of the upper end of the lower body portion 47. Thus, the accumulator container 326 has the joint portion J between the upper body portion 46 and the intermediate portion 49, and the joint portion J between the lower body portion 47 and the intermediate portion 49. As illustrated in FIG. 7, the supporting portion 49*a* has two through-holes 50*a* through which each of the low-pressure connecting pipes 31T and 31S passes, and a plurality of openings 50*b* through which the refrigerant passes.

Effect of Third Embodiment

According to the third embodiment, as with the first and the second embodiments, it is possible to use the accumulator container 326, which is made of a resin material having high vibration-damping properties, so that the generation of vibration of the rotary compressor 1 can be suppressed, and the noise associated with the vibration can be reduced. According to the third embodiment, as the intermediate portion 49 also serves as the supporting plate 35, the process of attaching the supporting plate 35 in the second embodiment can be omitted.

REFERENCE SIGNS LIST

1 ROTARY COMPRESSOR
10 COMPRESSOR HOUSING
10*a* OUTER PERIPHERAL SURFACE
11 MOTOR
12 COMPRESSION UNIT
25 ACCUMULATOR
26 ACCUMULATOR CONTAINER
31T, 31S LOW-PRESSURE CONNECTING PIPE (PIPE)
41 BODY PORTION
41*a* UPPER END
41*b* LOWER END
42 UPPER PORTION
43 LOWER PORTION
46 UPPER BODY PORTION
47 LOWER BODY PORTION
48 INTERMEDIATE PORTION
49 INTERMEDIATE PORTION
49*a* SUPPORTING PORTION
49*b* FLANGE PORTION
105 UPPER SUCTION PIPE (SUCTION PORTION)
104 LOWER SUCTION PIPE (SUCTION PORTION)
107 DISCHARGE PIPE (DISCHARGE PORTION)
J JOINT PORTION

The invention claimed is:

1. A rotary compressor comprising:

a compressor housing that is provided with a refrigerant discharge portion and a refrigerant suction portion;

a compression unit that is arranged inside the compressor housing and configured to compress a refrigerant, which is sucked from the suction portion, and discharge the refrigerant from the discharge portion;

a motor that is arranged inside the compressor housing and configured to drive the compression unit; and an accumulator that is fixed to an outer peripheral surface of the compressor housing and connected to the suction portion, wherein an accumulator container of the accumulator has a cylindrical body portion, which is formed of a resin material as a single member, an upper portion, which is formed of a metal material and closes an upper end of the cylindrical body portion, and a lower portion, which is formed of a metal material and closes a lower end of the cylindrical body portion, a lower end of the upper portion is joined to the upper end of the cylindrical body portion, and an upper end of the lower portion is joined to the lower end of the cylindrical body portion.

2. The rotary compressor according to claim 1, wherein, in the cylindrical body portion, an outer peripheral surface of the lower end of the upper portion is joined to an inner peripheral surface of the upper end of the cylindrical body portion, and an outer peripheral surface of the upper end of the lower portion is joined to an inner peripheral surface of the lower end of the cylindrical body portion.

3. The rotary compressor according to claim 1, wherein the cylindrical body portion has a cylindrical upper body portion, which is formed of a resin material and having an upper end to which the lower end the upper portion is joined, and a cylindrical lower body portion which is formed of a resin material, and having a lower end to which the upper end of the lower portion is joined, and a lower end of the cylindrical upper body portion and an upper end of the cylindrical lower body portion are joined.

4. The rotary compressor according to claim 3, wherein, in the accumulator container, the upper portion and the cylindrical upper body portion are integrally molded, and the lower portion and the cylindrical lower body portion are integrally molded.

5. The rotary compressor according to claim 1, wherein the cylindrical body portion has a cylindrical upper body portion, which is formed of a resin material and having an upper end to which the lower end of the upper portion is joined, a cylindrical lower body portion, which is formed of a resin material and having a lower end to which the upper end of the lower portion is joined, and an intermediate portion, which is formed of a metal material and is joined to an inner peripheral surface of a lower end of the cylindrical upper body portion and is jointed to an inner peripheral surface of an upper end of the cylindrical lower body portion.

6. The rotary compressor according to claim 5, wherein the accumulator has a pipe that is arranged inside the accumulator container, the intermediate portion has a supporting portion, which supports the pipe, and a flange portion, which is formed on an outer periphery of the supporting portion, and the flange portion is joined to the inner peripheral surface of the cylindrical upper body portion and the inner peripheral surface of the cylindrical lower body portion.

7. The rotary compressor according to claim 5, wherein, in the accumulator container, the intermediate portion is integrally molded with either the cylindrical upper body portion or the cylindrical lower body portion.

8. The rotary compressor according to claim 1, wherein the resin material is a thermoplastic resin material and has a functional group, which is reactive with the metal material.

* * * * *